US006349929B1

(12) United States Patent
Speltz et al.

(10) Patent No.: US 6,349,929 B1
(45) Date of Patent: Feb. 26, 2002

(54) WORKHOLDER APPARATUS

(76) Inventors: Ray R. S. Speltz, 19014 - 61st St. East, Sumner; Terry E. Hagel, 18713 McGhee Dr., Bonney Lake, both of WA (US) 98390

( * ) Notice: Subject to any disclaimer, the term of this patent is extended or adjusted under 35 U.S.C. 154(b) by 0 days.

(21) Appl. No.: 09/656,978

(22) Filed: Sep. 7, 2000

Related U.S. Application Data

(60) Provisional application No. 60/153,102, filed on Sep. 9, 1999.

(51) Int. Cl.[7] ..... B25B 1/20

(52) U.S. Cl. ..... 269/242; 269/71; 269/224

(58) Field of Search ..... 269/60, 224, 242, 269/244, 252, 285, 253, 250, 240; 125/23, 35; 308/3 A, 4 R, 6 R; 409/255, 219; 248/124, 284; 408/103

(56) References Cited

U.S. PATENT DOCUMENTS

| | | | | |
|---|---|---|---|---|
| 1,285,834 A | | 11/1918 | Stull | |
| 1,326,804 A | | 12/1919 | Taylor | |
| 1,471,118 A | | 10/1923 | Gething | |
| 1,674,291 A | | 6/1928 | Malone | |
| 1,948,600 A | | 2/1934 | Templeton | |
| 2,176,608 A | | 10/1939 | Marsilius | |
| 2,247,656 A | | 7/1941 | Friedrich | |
| 2,424,090 A | | 7/1947 | Gordinier | |
| 2,699,708 A | | 1/1955 | Fotsch | |
| 2,968,517 A | | 1/1961 | Daugherty et al. | |
| 3,991,478 A | | 11/1976 | Stone | |
| 4,192,521 A | * | 3/1980 | Smith | 269/242 |
| 4,208,045 A | * | 6/1980 | Rowe | 254/104 |
| 4,448,406 A | * | 5/1984 | Hallberg | 269/242 |
| 4,566,169 A | | 1/1986 | Vesely | |
| 4,613,120 A | | 9/1986 | Kozar | |
| 4,647,028 A | | 3/1987 | Yang | |
| 4,662,254 A | | 5/1987 | Noggle et al. | |
| 4,964,766 A | | 10/1990 | Turchan et al. | |
| 4,976,484 A | * | 12/1990 | Nomaru | 269/242 |
| 5,037,074 A | | 8/1991 | Lenzkes | |
| 5,129,637 A | | 7/1992 | Ito et al. | |
| 5,172,895 A | * | 12/1992 | Kilmach | 269/41 |
| 5,226,211 A | | 7/1993 | Jones | |
| 5,505,438 A | | 4/1996 | Baldwin et al. | |
| 5,553,838 A | | 9/1996 | Lee | |
| 5,586,754 A | | 12/1996 | Williams | |
| 5,702,096 A | | 12/1997 | Buck | |
| 5,718,422 A | | 2/1998 | Morghen | |
| 5,735,514 A | | 4/1998 | Moore et al. | |
| 5,762,326 A | | 6/1998 | Swann | |
| 5,862,718 A | | 1/1999 | Kiesling | |
| 5,893,551 A | | 4/1999 | Cousins et al. | |

* cited by examiner

*Primary Examiner*—Joseph J. Hail, III
*Assistant Examiner*—Daniel Shanley
(74) *Attorney, Agent, or Firm*—Garrison & Assoc. PS; David L. Garrison

(57) ABSTRACT

The present invention describes a workholding apparatus for holding workpieces that are to undergo various machining processes. The workholder apparatus is particularly suitable for numerically controlled machining applications. The workholder consists of a main body having a generally flat work surface and two or more clamping assemblies slidably located beneath the work surface. The invention includes a means for accurately and repeatably clamping a workpiece to the work surface, so that a part may be removed at an intermediate stage for examination or other processing, and returned to the workholder in the same location. A major advantage of the present invention is the clamping is accomplished without producing undesirable stresses in the workpiece, and all sides of the workpiece can be exposed for machining without changing the attachment of the workpiece in the workholder. A modular and extensible embodiment of the invention is also described.

7 Claims, 5 Drawing Sheets

FIG. 1
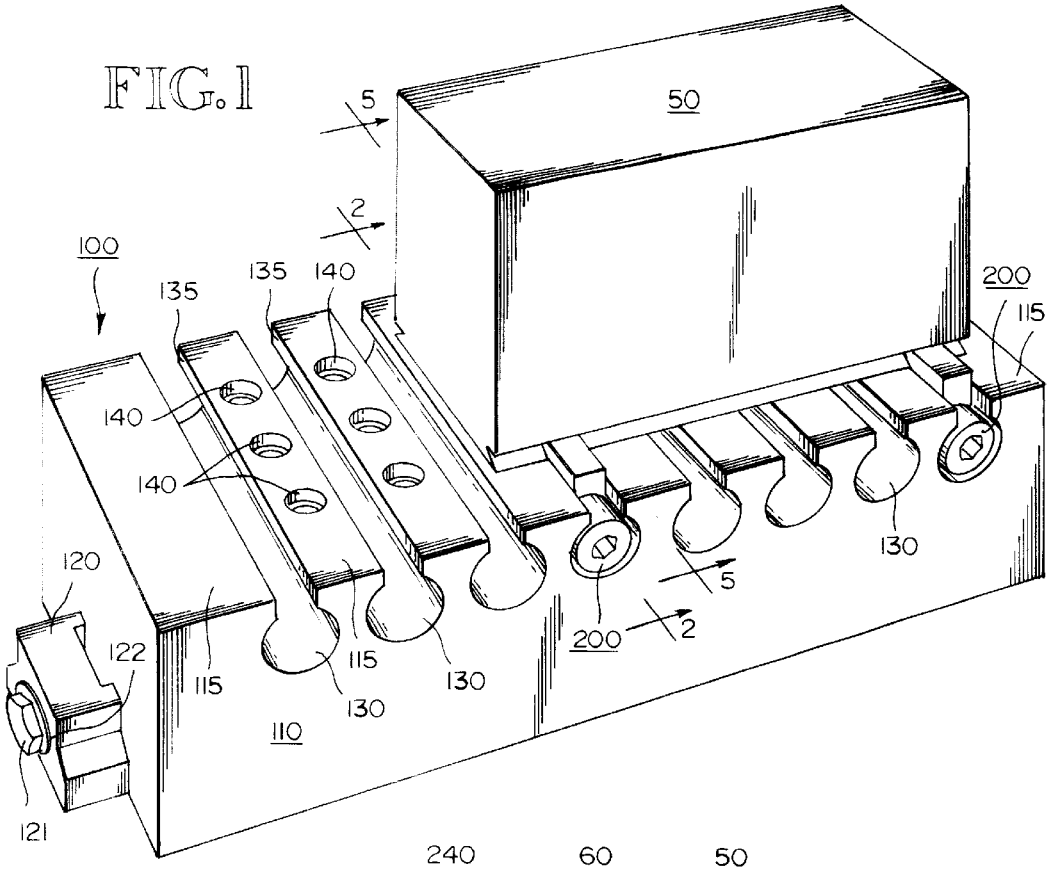
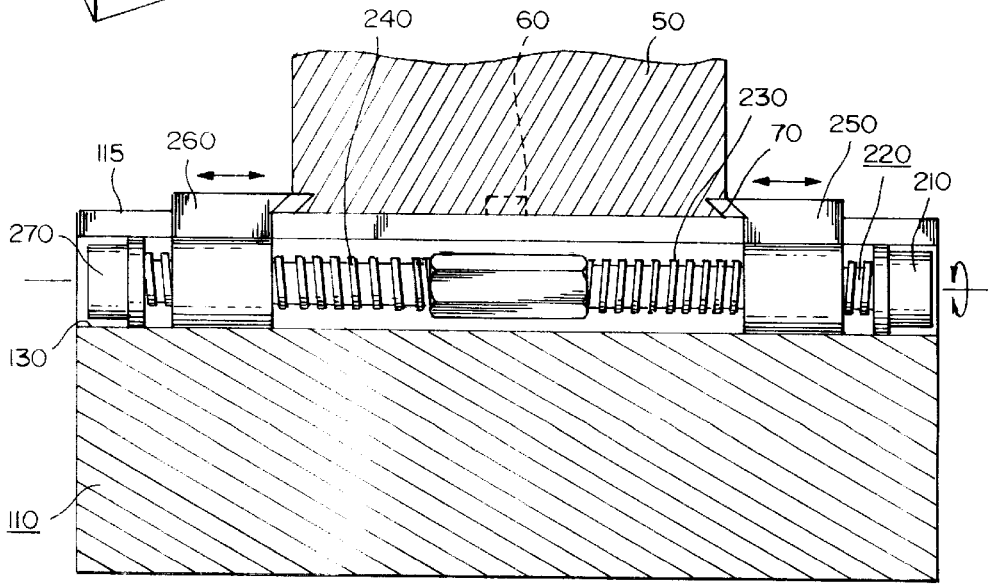
FIG. 2

WORKHOLDER APPARATUS

This application claims the benefit of U.S. Provisional Patent Application Ser. No. 60/153,102, filed Sep. 9, 1999, and entitled Workholder Apparatus.

FIELD OF INVENTION

The present invention relates to a workholder apparatus for rigidly clamping a workpiece for machining, and in particular to an apparatus capable of securely supporting workpieces of varying size that is suitable for numerically controlled machining applications.

BACKGROUND OF THE INVENTION

When raw material, or partially fabricated components, are to be machined, the workpiece must be securely clamped to a base plate or some other manufacturing platform to hold the workpiece stable at a precise, predictable position in a manner capable of resisting the forces on the workpiece produced by the machining operation to be performed. Typical machining operations include drilling, boring, honing, grinding and milling. In numerically controlled (NC) machining, for example, a machine tool such as a milling head is programmed to follow a very precise path. The workpiece must be located extremely precisely relative to the NC machine datum points/planes from which the machining path is related or measured.

A number of different indexing and clamping systems have been developed to permit a workpiece to be positioned at a specific location on a support plate. Frequently, the clamping means have fingers, jaws, straps or other means that extend over the side of the workpiece opposite the supporting surface. While generally effective, the upper surface clamps must be carefully positioned to avoid interference with the movement of the machine tool, such as a milling head, across the workpiece. The upper surface clamping means also restrict the machine tool's access to a portion of the workpiece.

Insufficient clamping pressure, or the use of too few clamps, may allow the workpiece to shift during machining, resulting in wasted, out-of-tolerance products and potential damage to the machine tool. Too much clamping pressure may result in damage to the workpiece either directly, or by elastically deforming the workpiece resulting in out-or-tolerance machining operations. Further, errors in clamp placement may result in the machine tool cutter running against the tool, resulting in damage to the clamps and to the machine tool. Such mishap could also result in a safety hazard to nearby personnel.

Another common practice is to use a vise to secure a workpiece when performing various manufacturing and machining operation on the workpiece. Prior art vises are typically used on precision machining equipment, such as numeric controlled equipment, to hold a workpiece during a defined machining operation. Such vises typically employ a pair of moving jaws perhaps with a fixed center jaw to permit simultaneous holding of two workpieces to permit a single working station to simultaneously perform machining operations on two different workpieces. These prior art vises typically use a threaded actuator shaft which has forward threads engaging one moving jaw and reverse threads engaging the other moving jaws to effect simultaneous opposed movement of the two moving jaws toward each other. Alternatively, one of the jaws may be connected in a non-threaded manner to the actuator shaft thereby engaging the workpiece only after the moving jaw has moved the workpiece to the fixed jaw. Prior art vises generally possess minimum flexibility with respect to their adaptability to various types of desired machining operations. In particular, prior art vises squeeze the workpiece between two, generally parallel jaws, relying on the frictional forces between the jaw face and the workpiece to hold the workpiece in place securely. This squeezing action can cause significant and undesirable compressive stresses in the workpiece.

In many workpiece operations, it is desirable to use a workholder that is equipped with jaws and a work surface that are at least as wide as the workpiece being machined to insure that the workpiece is adequately supported during the machining operation. Moreover, with increasing use of numerically controlled machines the workpiece must be clamped to the work platform at a very precise, or indexed, location so that the preprogrammed machining process will produce the desired operations. It is frequently desirable to present multiple workpieces to the machining apparatus, and to be able to machine all surfaces of the workpiece in a single operation, in order to reduce the amount of machine set-up and tool-change time. However, because the width of the work surface and the jaws of prior art workholding vises cannot be expanded to accommodate wider workpieces or pluralities of workpieces, the user may be forced to inventory a number of various sized workholders. Such workholders may typically cost several hundred dollars and, thus, the average machine owner cannot afford to maintain an extensive inventory of such workholder devices. It may also be beneficial to be able to remove a workpiece from the clamping apparatus for inspection or other purposes, and then return it to precisely the same position on the workholder.

There is a continuing need for improved indexing and clamping systems for workpieces to be machined. In particular, there is a need for a system that will reliably hold a workpiece, without slippage, in a manner that leaves most of the workpiece surface accessible for machining operations.

SUMMARY OF THE INVENTION

Accordingly, it is an object of the present invention to provide a workholder apparatus for securely and removably holding workpieces for machining operations. The workpieces to be used with the workholding apparatus described herein are pre-fabricated with wedge-shaped grooves along two opposite sides and circular indexing apertures in the bottom surface. The workholder apparatus consists of a main body having a generally flat work surface that includes at least two parallel cylindrical apertures that intersect the mounting surface thereby defining open slots in the work surface. Precisely located index pin apertures are provided in the main body that extend from the work surface into the main body. Index pins are inserted into the index pin apertures with a portion of the index pin protruding upwardly from the work surface. The protruding portion of the index pin slidably engage the indexing apertures on the bottom surface of the workpiece, thereby precisely locating, or indexing, the workpiece on the work surface. Clamp assemblies consisting of a threaded clamp rod with two clamp dogs having a wedge-shaped portion that may be moved toward each other are inserted into the cylindrical apertures of the main body, with the wedge-shaped portion of the clamp dogs protruding above the work surface. The wedge-shaped portion of the clamp dogs engage the wedge-shaped grooves in the workpiece to secure the workpiece to the workholder.

It is a further object of the present invention to provide a workholder apparatus that securely clamps a workpiece for machining operations while introducing minimal compressive stresses in the workpiece.

It is a further object of the present invention to provide a workholder that does not introduce bending stresses into the workpiece.

It is a further object of the present invention to provide a workholder apparatus that can precisely locate the workpiece on the workholder in a repeatable manner so that a workpiece that has been removed from the workholder may be re-installed on the workholder in its original location.

It is a further object of the present invention to provide a workholder apparatus that is modular and extensible to accommodate multiple workpieces and/or workpieces of differing sizes and shapes.

These and such other objects of the invention as will become evident from the disclosure below are met by the invention disclosed herein. In addition to the explicitly claimed method and apparatus described herein, as such, it is to be understood that all new and useful devices or components described herein are considered to constitute a part of the invention, claimable in their own right, whether such is stated with particularity herein or not.

BRIEF DESCRIPTION OF THE DRAWINGS

FIG. 1 is a perspective view of the workholder apparatus of the present invention with a work piece clamped to the device in preparation for machining.

FIG. 2 is a lengthwise sectional view of the workholder apparatus depicted in FIG. 1 showing the movement of the clamp dogs.

BEST MODE OF CARRYING OUT THE INVENTION

Figure 3:
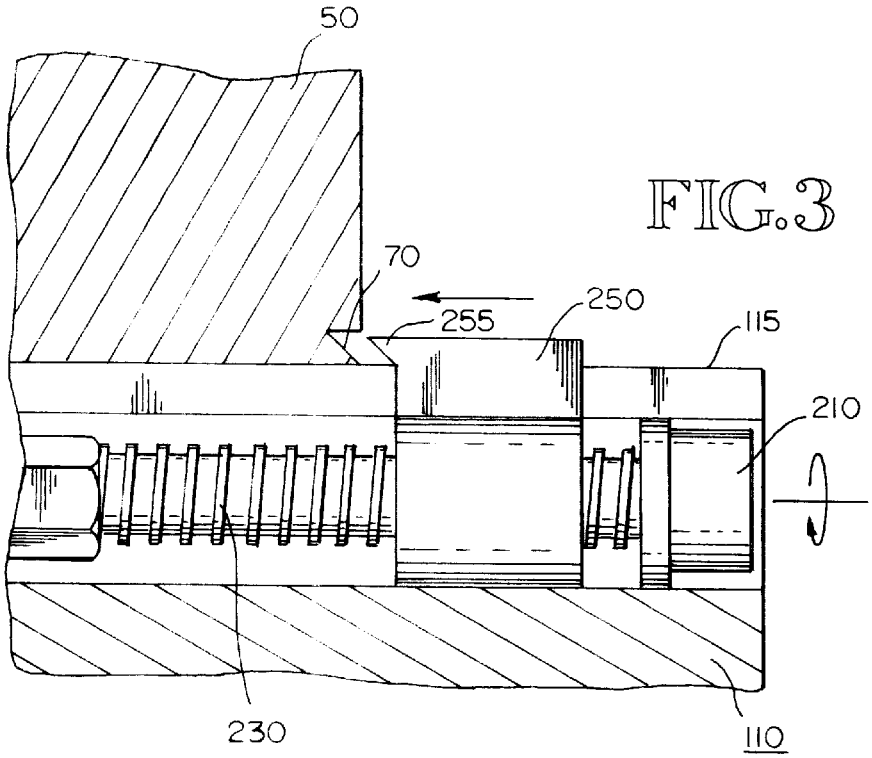
FIG. 3 is a fragmentary sectional view of the workholder apparatus of FIG. 1, showing a clamp dog prior to engagement of the workpiece.

Turning now to the drawings, the invention will be described in a preferred embodiment by reference to the numerals of the drawing figures wherein like numbers indicate like parts.

One preferred embodiment of the apparatus of the present invention is shown in FIG. 1. The workholder depicted has a main body 110 having a mounting surface 115 to which a workpiece 50 is mounted in position for machining. The main body 110 includes a plurality of parallel cylindrical clamp apertures 130 directly below, and parallel to, the mounting surface 115. the clamp apertures 130 are not necessarily circular, and in this preferred embodiment the clamp apertures 130 are generally key-shaped in cross-section. The keyed portion of the clamp apertures 130 intersect the mounting surface 115, thereby forming a plurality of parallel slots 135 on the mounting surface 115 that open to the clamp apertures 130. It is important that the clamp apertures 130 have a uniform cross-section and be parallel to the mounting surface 115 in order to create parallel slots 135 in the mounting surface 155 that have a uniform width.

The main body 110 also has a hasp spud 120 attached to one end, preferably with a bolt 121 and washer 122. The hasp spud 120 provides a means for attaching the main body 110 to the movable bed of a milling machine (not shown). As can best be seen in FIG. 7, a mounting aperture 410 is also provided on the end of the main body opposite the hasp spud 120.

Clamp assemblies 200 are provided to securely hold the workpiece 50 firmly against the mounting surface 115. As can best be seen in FIG. 2, the clamp assembly 200 comprises a clamp rod 220 having threads 230, 240 along a portion of its length. In this preferred embodiment, threaded portion 230 has right-hand threads, and threaded portion 240 has left-hand threads. Two oppositely disposed clamp dogs 250, 260 each have an open circular cylindrical portion having internal threads that engage respectively threaded portions 230, 240, whereby rotation of clamp rod 220 results in clamp dogs 250, 260 moving toward, or away from, each other, depending on the direction of rotation. An alternate configuration for the clamp assemblies that would be obvious to one of ordinary skill in the art, would have only one end of the clamp rod 220 threaded. One clamp dog 250, would slidably engage the clamp rod 220, and a stop means would be attached to the clamp rod 220 behind the clamp dog 250 thereby preventing it from sliding off the clamp rod 220. Rotation of the clamp rod 220 would therefor move the threaded clamp dog toward the unthreaded clamp dog to achieve a result similar to the doubly-threaded embodiment previously described.

Figure 4:
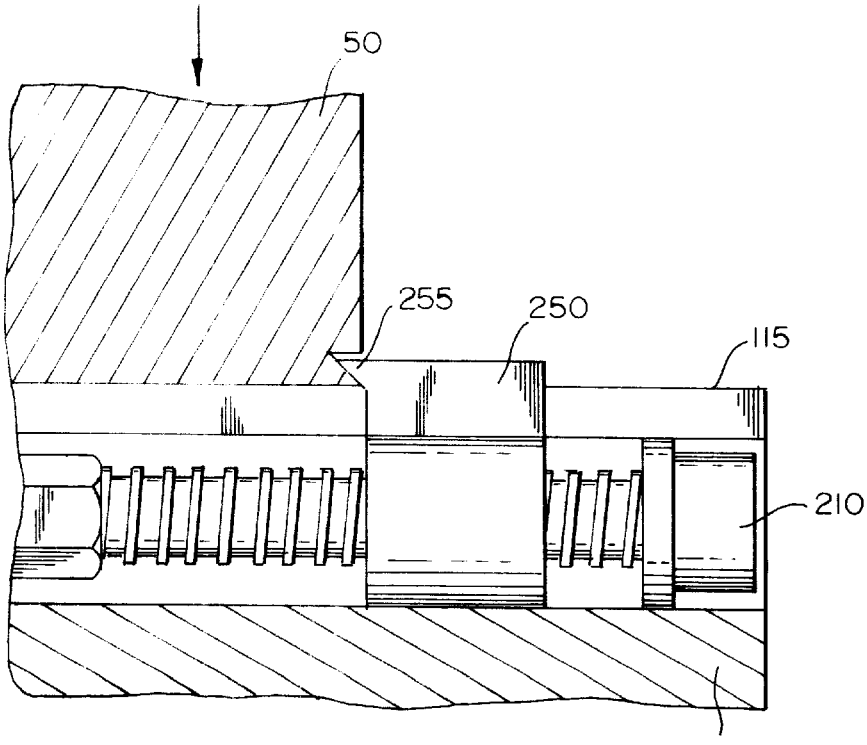
FIG. 4 is a fragmentary sectional view of the workholder apparatus of FIG. 1, showing how the shape of the clamp dog and the workpiece groove produce a downward clamping force from horizontal movement of the clamp dogs.
Figure 5:
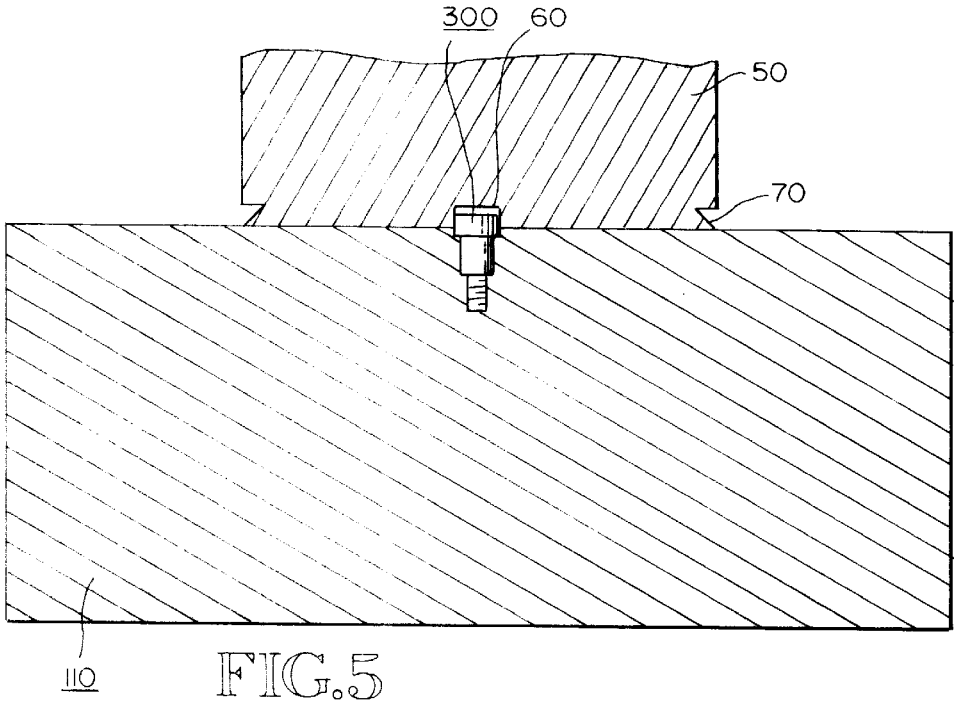
FIG. 5 is a fragmentary sectional view of the workholder apparatus of FIG. 1 showing the indexing pin interconnecting the work piece and the main body of the workholder.

The clamp assembly 200, including the clamp dogs 250, 260 are sized to be slidably inserted into a clamp aperture 130. The clamp dogs 250, 260 have a generally rectangular portion which protrudes from one side that slideably engage a slot 135 when the clamp assembly 200 is inserted into a clamp aperture 130. As can best be seen in FIGS. 3 and 4, the protruding portion of the clamp dogs 250, 260 include a wedge portion 255, that is designed to engage compatible wedge-shaped grooves 70 in the workpiece 50. Workpieces 50 that are to be mounted in the workholder apparatus 100 must be fabricated with wedge-shaped grooves 70 on oppositely disposed vertical faces, as shown in FIG. 1. In the preferred embodiment, the wedge-shaped grooves 70 have a horizontal face cut into opposing sidewalls of the workpiece 0.125 inches above the base of the workpiece and an angled face extending from the bottom edge of the workpiece 50 up to the horizontal cut making a 30 degree angle with the bottom face, as can best be seen in FIGS. 1–5. Complementary wedge portions 255 of the clamp dogs 250, 260 engage the wedge-shaped grooves 70 to hold the workpiece 50 securely to the workholder apparatus 100. As can best be seen in FIGS. 3 and 4, by locating the clamp dogs 250, 260 such that the wedge portion 255 is slightly downwardly offset with respect to the wedge-shaped groove 70 in the workpiece 50, lateral tightening of the clamp dogs 250, 260 will produce a downward force on the lower portion of the workpiece 50 producing a compressive force between the workholder apparatus work surface 115 and the workpiece 50. This configuration has been found to reliably secure the workpiece 50 to the workholder apparatus 100 in a manner able to withstand the various forces induced in the machining process without slippage.

It will also be appreciated that the clamp assembly 200 is slidably inserted into a clamp aperture 130, and is therefore free to translate back and forth linearly in one direction. Similarly, the wedge-shaped grooves 70 in the workpiece 50 slidably engage the wedge portions 25 of the clamp dogs 250, 260 in a direction perpendicular to the clamp assemblies' main axis. Therefore, the workpiece may be located anywhere on the work surface 115 of the main body 110, as can best be appreciated by examination of FIG. 1. Moreover, when the workpiece 50 is clamped to the workholder apparatus 100, the clamp assemblies 200 do not induce any lateral bending stresses in the workpiece 50.

Figure 6:
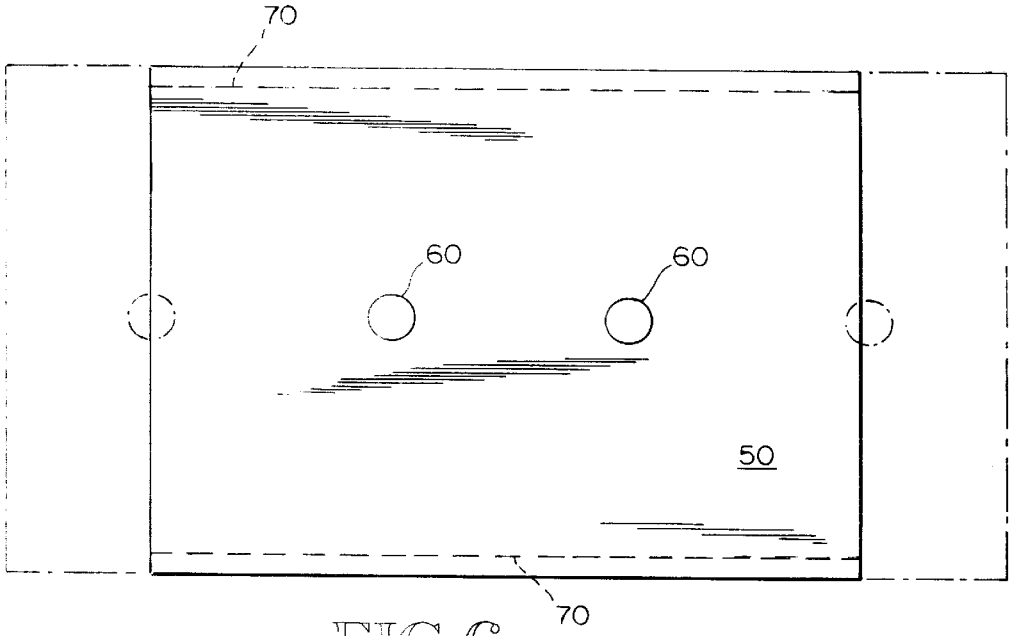
FIG. 6 is a bottom view of the workpiece after it has been prepared for installation onto the workholder apparatus of FIG. 1.

A plurality of index pin apertures 140 depending perpendicularly from the work surface 115 are provided. In the preferred embodiment of FIG. 1, three rows of index pin apertures 140 are shown. It will be appreciated that fewer rows of index pin apertures may be sufficient for smaller applications and additional rows may be provided for larger and/or irregularly shaped workpieces. Index pins 300 may be slidably or screwably inserted into the index pin apertures 140 to provide a means for transversely locating the workpiece 50. When an index pin 300 is inserted into an index pin aperture 140, the head 310 of the index pin 300 protrudes upwardly from the work surface 115. In the preferred embodiment the index pin 300 protrudes 0.125 inches above the work surface 115, matching the height of the workpiece grooves 70. As shown in FIG. 6, the workpiece 50 is pre-fabricated with short cylindrical indexing apertures 60 spaced and sized to slidably engage one or more protruding head 310 of the index pin 300. The index pin 300 in the preferred embodiment is a standard ⅜ by ½ shoulder bolt with the top circular edge of the head 310 rounded to facilitate insertion into the indexing aperture 60 of the workpiece 50.

A unique aspect of the invention disclosed herein is that the transverse, or horizontal, location of the workpiece 50 on the work surface 115 of the workholder apparatus 100 is determined by the index pins 300, and is independent of clamping the workpiece 50 to the workholder apparatus 100. After locating the workpiece 50 on the workholder apparatus 100, it is clamped downwardly, creating a compressive and frictional interface with the work surface 115 without introducing lateral bending stresses into the workpiece 50. Because the primary clamping force is applied vertically between the bottom portion of the workpiece 50 and the work surface 115, the compressive stresses applied to the workpiece are much less than in prior art vises. The workpiece 50 sits on top of the work surface 115, and is indexed and clamped very near the bottom surface of the workpiece 50. Therefore the top surface and substantially all of the periphery of the workpiece are exposed for machining or other processing.

Figure 9:
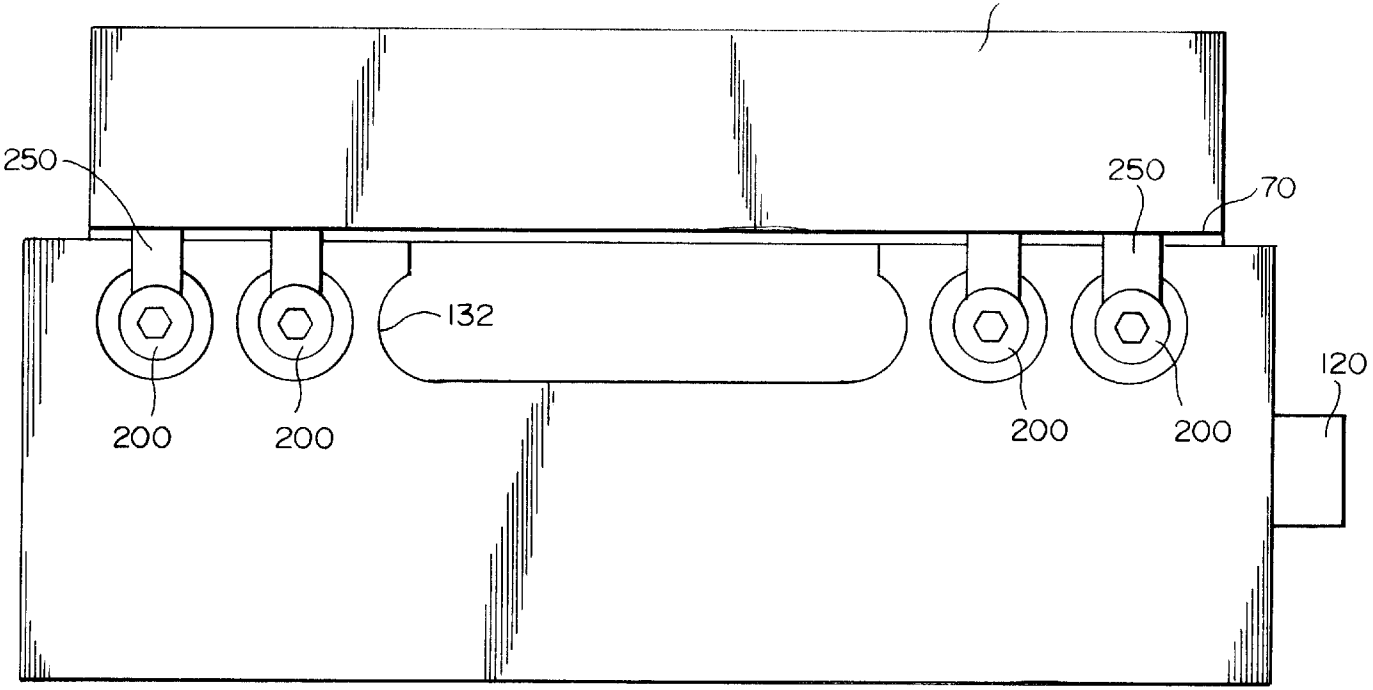
FIG. 9 shows an elevation view of another embodiment of the workholder apparatus of FIG. 1 wherein an elongated aperture in the main body of the workholder provides access to a portion of the bottom surface of the workpiece.
Figure 8:
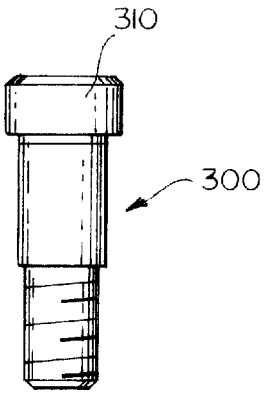
FIG. 8 shows an elevation view of an index pin for the workholder apparatus of FIG. 1.

In another embodiment of the present invention, shown in FIG. 9, an additional aperture 132 is provided at the top portion of the main body 110 that is parallel to the clamp apertures 130. The additional aperture 132 exposes a portions of the bottom face and bottom edge of the periphery of the workpiece 50 for machining or other processing. It will be appreciated by one of ordinary skill in the art that there is significant cost advantages and time savings associated with the ability to machine all sides of a workpiece without having to stop and change the attachment of the workpiece in the machining apparatus.

Figure 7:
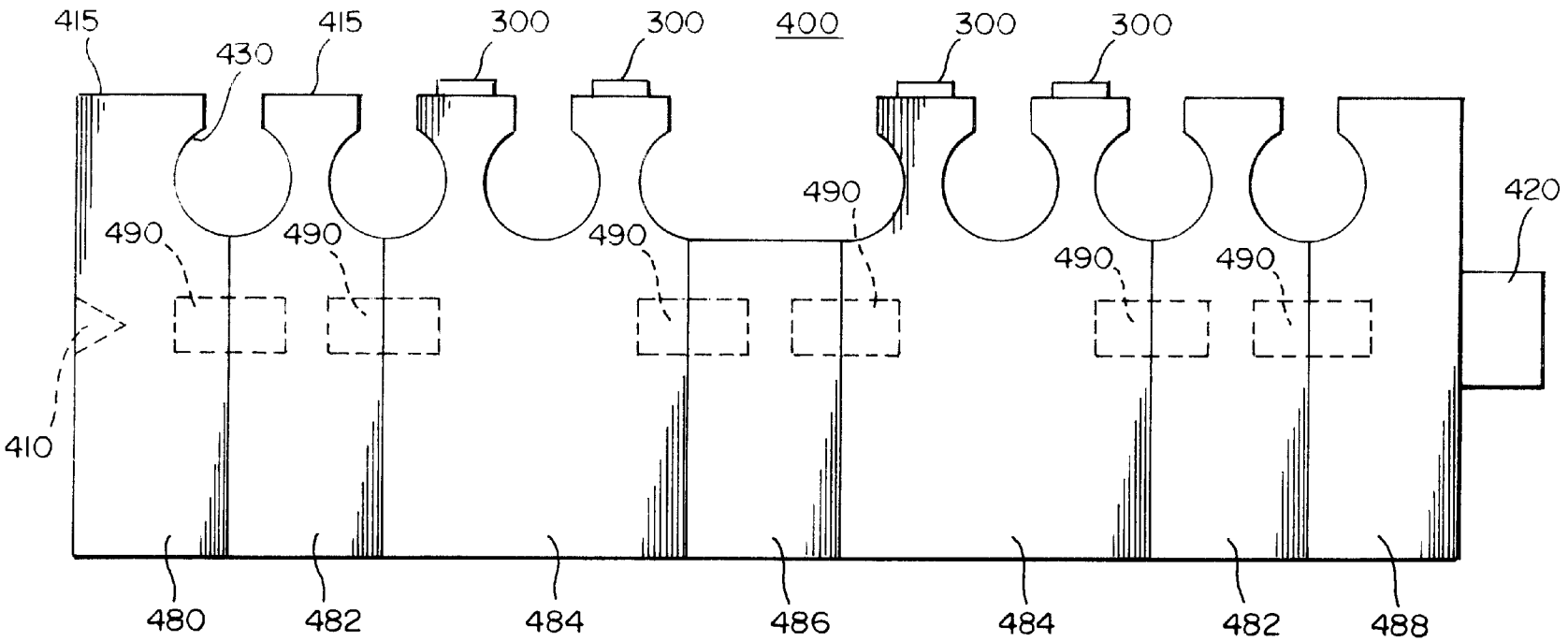
FIG. 7 shows another embodiment of the workholder apparatus of the present invention wherein the body of the workholder is modularly produced from a number of body segments connected and aligned with connecting pins.

In another embodiment of the present invention shown in FIG. 7, the main body 400 is modularly designed, allowing for an extensible workholder apparatus. In the modular embodiment the main body 400 of the workholder apparatus is comprised of a plurality of body segments 480, 482,484, 486,488 providing an apparatus that may be used for a variety of different applications. For example, in the preferred embodiment shown a left body segment 480 contains a mounting aperture 410 and half of a clamp aperture 430. A center body segment 482, symmetric about its vertical centerplane includes half clamp apertures 430 on opposite sides. A double body segment 484 consists essentially of two center body segments 482 fabricated as a single piece. An extension body segment 486 that is generally rectangular may be included to provide an additional aperture for accessing a portion of the bottom surface of a workpiece 50. A right body segment 488 provides an end segment having a hasp spud 420 for attachment to a milling table or similar apparatus. A means is provided for locking the body segments together. The preferred embodiment shown in FIG. 7 connects the body segments with a plurality of body connecting pins 490 that are slidably connected to the body segments in apertures provided for that purpose. The body connecting pins 490 may be fixedly attached to one side of each body segment 482,484,486,488, with the other side of the body segments 480, 482,484,486 containing matching apertures to receive the body connecting pins 490. It will be obvious to one of ordinary skill in the art that many other means may be used to connect the body segments together, including providing keyed notches and grooves on each body segment, providing alignable holes through each body segment that slidably receive a threaded rod for bolting the body segments together, and providing an external frame for holding and aligning the body segments.

It will be appreciated that the modular embodiment of the present invention may be easily assembled in any number of variations, using the body segments shown, or obvious variations thereon. The modular main body 400 can be rapidly modified to accommodate the various needs encountered by a manufacturer, and additional apertures that allow access to the bottom face of a workpiece may be interposed as needed by any particular application. This extensibility of the modular workholder apparatus would allow a machine shop operator, for example, to keep a minimal inventory of clamping components, and to easily expand the clamping capacity as the need arises. For example, if the owner is faced with an unexpectedly high demand for a given component the workholding apparatus may be expanded to allow more parts to be machined in a given operation.

We claim:

1. A workholder apparatus for removably attaching workpieces having elongated wedge-shaped channels along two sides thereof and at least one indexing aperture on its bottom surface, to said workholder apparatus, said workholder apparatus comprising:

i. a main body having a proximal end, a distal end and a mounting surface between said proximal and distal ends, said body including a plurality of elongated cylindrical apertures extending transversely therethrough having a portion that intersects said mounting surface thereby defining a plurality of open slots in said mounting surface, and a plurality of index pin apertures between said open slots that extend from said mounting surface into said main body;

ii. a plurality of clamp assemblies insertable into said cylindrical apertures, said clamp assemblies comprising:

a. a clamp rod having threads along a portion of its length and a turning means fixedly attached at one end, b. a first clamp dog having a threaded aperture therethrough screwably attachable to said clamp rod and a first wedge portion that protrudes through said open slot when said clamp assembly is inserted into one of said cylindrical apertures, c. a second clamp dog having an aperture therethrough attachable to said clamp rod between said turning means and said first clamp dog, and a second wedge portion that protrudes through said open slots when said clamp assembly is inserted into one of said cylindrical apertures;

iii. at least one index pin having a proximal end and a distal end, said proximal end insertable into one of said index pin apertures such that said distal end of said index pin protrudes from said mounting surface of said main body, and said distal end sized to slidably insert into said indexing aperture of said workpiece.

2. The workholder apparatus of claim 1 wherein said second clamp dog is slidably attachable to said clamp rod whereby said first clamp dog may be moved relative to said second clamp dog by rotating said clamp rod.

3. The workholder apparatus of claim 1 wherein said clamp rod additionally has a portion with reverse threads and said aperture on said second clamp dog is threaded to mate with said reverse threads and is screwably attachable to said clamp rod whereby said first and second clamp dogs may be moved relative to each other by rotating said clamp rod.

4. The workholder apparatus of claim 1 further comprising a means for attaching said workholder apparatus to an indexing table.

5. The workholder apparatus of claim 1 wherein said plurality of indexing apertures are uniformly spaced across said mounting surface of said main body.

6. The workholder apparatus of claim 1 wherein said main body comprises a plurality of body segments having a means for assembling said body segments.

7. The workholder apparatus of claim 1 wherein said main body has a cutout portion between said proximal end and said distal end at said mounting surface whereby a workpiece may be attached to said mounting surface straddling said cutout portion thereby exposing a portion of the bottom side of said workpiece.

* * * * *